United States Patent [19]

Champagne

[11] Patent Number: 4,949,997

[45] Date of Patent: Aug. 21, 1990

[54] BINDING SYSTEM FOR FLAT MATERIAL OF VARYING THICKNESS

[75] Inventor: Michel Champagne, Laval, Canada

[73] Assignee: Les Profiles d'Extrusion Plastival, Inc., Canada

[21] Appl. No.: 382,741

[22] Filed: Jul. 19, 1989

[51] Int. Cl.[5] ..... B42D 17/00

[52] U.S. Cl. ..... 281/45; 281/42; 40/530

[58] Field of Search ..... 281/27.1, 42, 21.1, 281/22, 45, 46, 47, 28, 48, 49, 17; 402/80 R, 65, 68, 62; 211/45, 46, 47, 162, 94, 7, 8, 9; 411/500, 510, 50; 40/158, 530, 605, 617, 649, 658; 16/368, 369, 371, 262

[56] References Cited

U.S. PATENT DOCUMENTS

| | | | |
|---|---|---|---|
| 33,507 | 10/1861 | Miller . | |
| 243,772 | 7/1881 | Glover . | |
| 943,431 | 12/1909 | Lull | 281/17 |
| 2,042,656 | 6/1936 | Hare . | |
| 2,127,619 | 11/1936 | Rosenthal | 281/17 |
| 3,353,844 | 11/1967 | Staats | 281/17 |
| 3,752,503 | 8/1973 | Holes et al. | 281/17 |
| 3,768,838 | 10/1973 | Shibata | 281/17 |
| 3,793,758 | 2/1974 | Feldhusen et al. . | |
| 3,945,140 | 3/1976 | Sullivan et al. . | |
| 4,147,257 | 4/1979 | Zippel | 211/45 |
| 4,521,035 | 6/1985 | Berezowsky . | |

*Primary Examiner*—Paul A. Bell
*Assistant Examiner*—Hwei-Siu Payer
*Attorney, Agent, or Firm*—Mason, Fenwick & Lawrence

[57] ABSTRACT

A two-part binding system is disclosed, comprising an elongated sheet holder and a twin-barrel link made up of adjacent tubular portions. The sheet holder comprises an elongated planar sheet-holding section which is expandable to accommodate documents of different thicknesses. One side of the sheet-holding section terminates in a plurality of tubular barrels arranged in a spaced-apart relationship. A plurality of the links are placed in the spaces between the barrels of the sheet holders and are aligned so that a pin can pass through the barrels of both the sheet holders and the links. The links are staggered relative to each other to facilitate joining of several sheet holders in a compact, expandable book-like unit.

15 Claims, 3 Drawing Sheets

BINDING SYSTEM FOR FLAT MATERIAL OF VARYING THICKNESS

BACKGROUND OF THE INVENTION

The present invention generally relates to holders or binders for flat materials such as sample sheets, paper, magazines, catalogs and the like. Specifically, the present invention relates to an interlocking device for binding a plurality of sheets of thick, flat material of varying thickness into a single book.

FIELD OF THE INVENTION

Many different binders for sheet material exist. The most common of these is the three-ring loose-leaf binder, which comprises a set of selectively closable metal rings permanently affixed to a binder cover. Sheets to be inserted into the binder must be punched with holes which engage the binder rings. Although the rings can be fashioned in different sizes, certain physical limitations prevent the binder rings from being larger than approximately 4" in diameter. This limited capacity is insufficient for certain binding applications, such as binding samples, catalogs and other thick material.

Furthermore, such ring binders do not readily permit thick material to move within the binder, since the holes in such thick material tends to rub against the narrow diameter of the binder rings, preventing free movement.

Finally, opposite pages of material inserted into a ring binder are separated by a gap of several inches when the binder is open This gap is unacceptable when samples must be closely compared side-by-side.

Another well known form of binding is plastic spiral binding. The spiral binding system comprises a specialized punching machine, adapted to punch a plurality of holes in the material to be bound, and plastic binding spines of various radial diameters. This binding system requires significant mutilation of the material to be bound since many holes must be drilled into the material to accept the plastic spines. Secondly, the plastic spines are provided only in fairly small diameters (typically ⅝" to 1"). Last, the binding requires use of a special punching and assembly machine, and operation of the machine in the binding system requires significant educational time.

Yet another common binder is the post-hole binder. This binding system comprises a vinyl or other rigid cover, similar to those used with three-ring binders, and a plurality of rigid metal rods which are inserted through holes drilled in the material and which are affixed permanently to the binder cover. Again, this type of binder requires several large holes to be drilled into the material. Furthermore, post-hole binders do not permit the bound volume to be opened flat for review or examination.

In the past, several attempts have been made to overcome the disadvantages of various types of binding systems. For example, U.S. Pat. No. 3,945,140 (Sullivan et al) discloses a folding album case for binding a plurality of photographs, cards or other material. However, the patent of Sullivan et al does not permit introduction of additional material after the fixed capacity of the device has been filled. Similarly, U.S. Pat. No. 243,772 (Glover) shows a flat-opening album for holding photographs or other flat material. Unfortunately, the Glover device is also of fixed capacity, and the sheet-holders disclosed are not adapted for holding material of varying thicknesses. This disability is shared by the display holders disclosed in U.S. Pat. No. 2,042,656 (Hake).

The need to easily bind material of significantly differing thicknesses was recognized in U.S. Pat. No. 4,521,035 (Berezowsky), which shows an interlocking device for holding papers or sheets, comprising a U-shaped sheet holder of resilient material having two arms extending from a base, a rod member extending from the base, and a groove opposite the rod such that the groove can receive the rod member of a similar adjacent device. The primary disadvantage of the Berezowsky disclosure is that the sheet holders must be manufactured of a relatively friction-free material, since the ball-and-socket joint used to connect adjacent sheet holders must swivel with little friction to facilitate opening the bound book and examining sheets therein. Since the binding devices must be made of a relatively narrow range of materials, their versatility is limited.

Therefore, those using sample or catalog holders would find it useful to have a binding system providing flexibility in holding sheets in that the holder can accommodate material of varying thickness. Furthermore, persons using such binding systems would find it useful to have a binding system capable of expansion to a theoretically unlimited thickness, such that additional material can be added to the binder without the fear of exceeding the capacity of the binder. Finally, users of binding systems would appreciate a system which permits rapid and easy movement of sheets within the binding system.

SUMMARY OF THE INVENTION

Accordingly, it is one object of the present invention to provide a binding system having an interlocking pair of members which may be joined to other similar members producing a bound volume of almost any size.

It is another object of the present invention to provide a binding system which does not require perforation or mutilation of material to be inserted within the system.

It is yet a further object of the present invention to provide a binding system capable of accommodating material of varying thickness.

It is still a further object of the present invention to provide a binding system which may be manufactured in a variety of materials, such that utility of the invention is not limited by considerations such as friction, cost of materials, etc.

The foregoing objects of the invention, and other objects, are achieved through a two-part binding system comprising an elongated sheet holder and a twin-barrel link made up of adjacent tubular portions. The sheet holder comprises an elongated planar sheet holding section which is flexibly expandable to accommodate sheets of material of different thicknesses. One side of the sheet-holding section terminates in a plurality of spaced-apart coaxial barrels. A plurality of the links are placed in the spaces between the barrels and are fastened together by a rod or pin passing therethrough to form a hinge. The links are staggered relative to each other to facilitate joining of a plurality of sheet holders in a compact book-like unit.

DETAILED DESCRIPTION OF THE PREFERRED EMBODIMENTS

Figure 1:
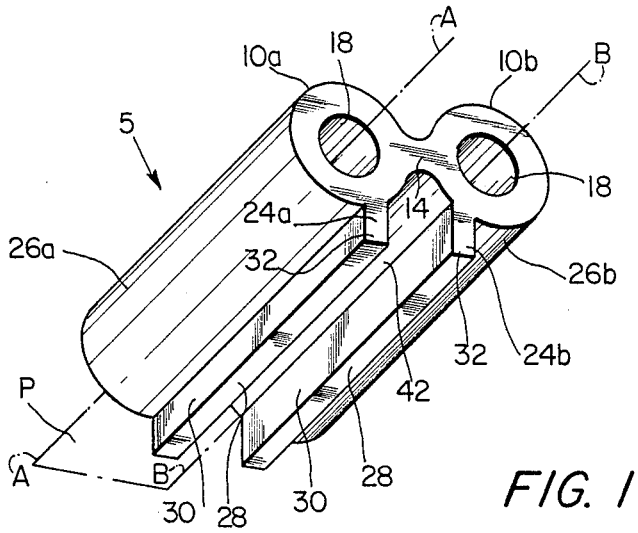
FIG. 1 is a perspective drawing of the twin-barrel link portion of a binding system incorporating the teachings of the present invention.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
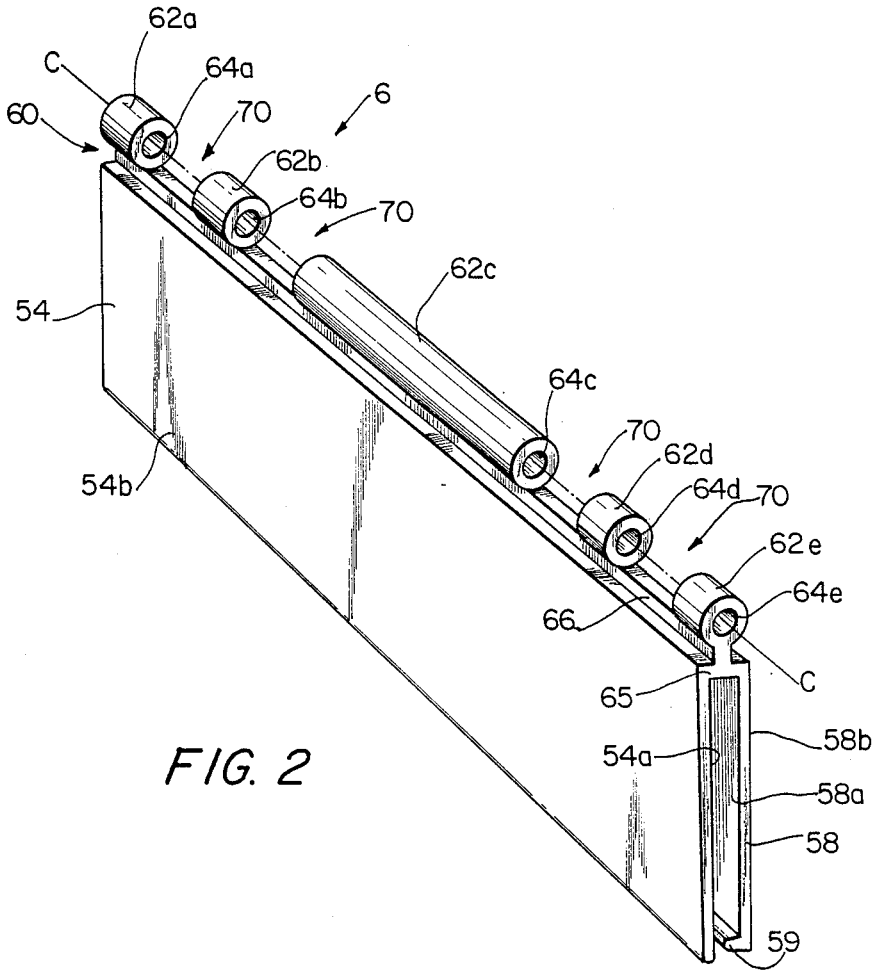
FIG. 2 is a perspective drawing of the sheet-holder portion of the binding system of FIG. 1.

Referring generally to the preferred embodiment illustrated in FIGS. 1 through 4, the binding system comprises two parts, a twin-barrel link member 5 depicted in detail in FIG. 1, and an elongated sheet holder 6 for gripping sheets and interlocking with link member 5, which sheet holder is depicted in detail in FIG. 2.

Referring specifically now to FIG. 1, the twin-barrel link member 5 of the present invention is of unitary construction and comprises first and second elongated cylindrical barrels 10*a* and 10*b* having parallel longitudinal axes A and B forming a plane P. Barrels 10*a* and 10*b* are joined or molded side-by-side, forming a central fillet 14. Each barrel 10 includes a longitudinally extending axial bore 18 for a purpose to be described hereinafter.

First and second ridges 24*a* and 24*b* extend integrally from barrels 10*a* and 10*b*, respectively, also for a purpose to be described hereinafter. They extend outwardly from the outer surfaces 26*a* and 26*b* of barrels 10*a* and 10*b*, respectively, perpendicular to plane P. Each of ridges 24*a* and 24*b* includes top walls 28, side walls 30 and end walls 32. The links 5 are preferably short in length, typically 1" (2.54 cm). Ridges 24 define a seating space 42 for a purpose to be described hereinafter.

Figure 4:
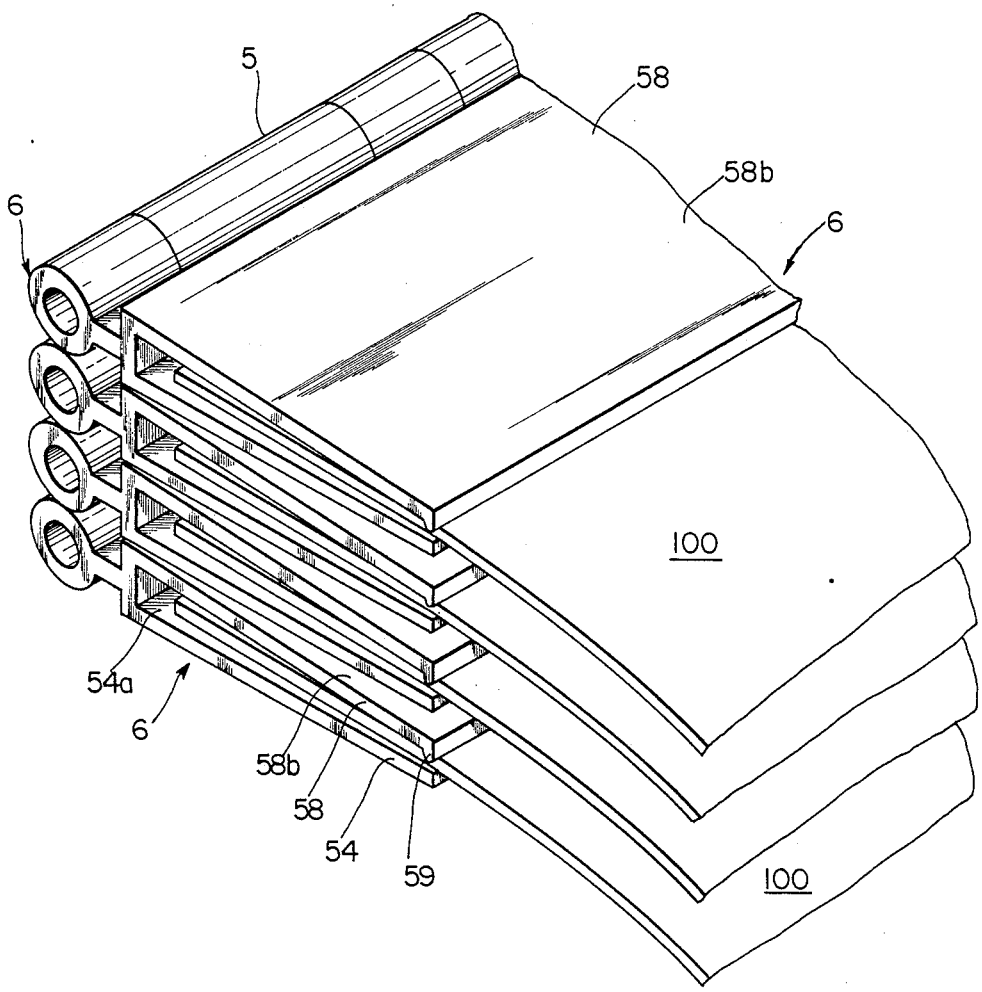
FIG. 4 is a perspective drawing of the binding system of FIG. 3 holding flat sheets of material.

Referring specifically now to FIGS. 2 and 4, the sheet holder 6 of the present invention is of unitary construction and comprises a substantially planar sheet-holding arm 54 and a substantially planar gripping arm 58. Arm 54 includes substantially planar inner and outer faces 54*a* and 54*b*, and arm 58 includes substantially planar inner and outer faces 58*a* and 58*b*. An elongated document-gripping lip 59 extends inwardly at an essentially right angle from inner face 58*a* along the length of arm 58. Arms 54 and 58, and the lip 59, are constructed of preferably resilient material having a thickness of approximately ⅛" (0.32 cm).

The arms 54 and 58 are joined with a spine 60. A plurality of spaced-apart cylindrical barrels 62*a* through 62*e* coaxial along a longitudinal axis C extend outwardly from spine 60. Barrels 62*a* through 62*e* have the same outer diameter as barrels 10*a* and 10*b*. Barrels 62*a* through 62*e* are provided respectively with axial bores 64*a* through 64*e* having the same diameter as bores 18*a* and 18*b*. Barrels 62*a* through 62*e* can be all the same length or of varying lengths. As shown in FIG. 2, barrels 62*a*, 62*b*, 62*d* and 62*e* are all the same length, while barrel 62*c* located at the center is longer than the other four. Also, the number of barrels 62 can be varied. However, barrels 62 must be equally spaced apart by a distance substantially equal to the length of barrels 10*a* and 10*b* so that, as will be described in greater detail hereinafter, barrels 24*a* and 24*b* can be received between barrels 62.

As oriented in FIG. 2, spine 60 includes a lateral portion 65 extending between arms 54 and 58, and substantially perpendicular to arm 54, and a ridge portion 66 extending outwardly from lateral portion 65. The maximum width of gripping arm 58 is at lateral portion 65, and is substantially equal to the distance between axes A and B of barrels 10*a* and 10*b*, for a purpose to be described hereinafter. Barrels 62 extend radially from ridge portion 66.

Arm 58 is joined to spine 60 at an angle of slightly less than 90°. Thus, gripping arm 58 is oriented at a slight angle with respect to sheet-holding arm 54, such that when the arms 54 and 58 are forced into parallel position by insertion of a sheet of material to be bound within the arms 54 and 58, spring tension causes the material to be firmly gripped within the arms 54 and 58 by lip 59.

In a preferred embodiment, both link member 5 and sheet holders 6 of the present invention are constructed using single-piece injection molding of ABS plastic or similar resilient material. The material must be resilient so that arms 54 and 58 can be separated to insert a sheet of material between them and then return to their initial positions so that gripping lip 59 grips the sheet bound in the system with sufficient spring tension.

Barrels 62*a* through 62*e* are separated from one another by spaces 70. Spaces 70 are substantially equal to, but slightly greater than, the length of link member 5 shown in FIG. 1 for receiving one of barrels 24*a* or 24*b* of a link member 5.

Figure 5:
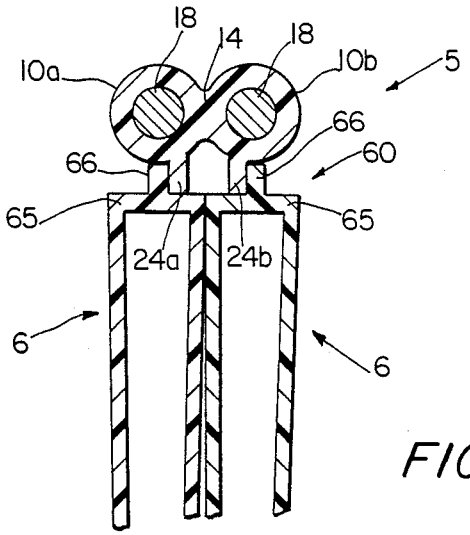
FIG. 5 is a partial cross-sectional drawing of the inventive binding system with two sheet-holder portions adjacent to one another and interlinked as shown in FIG. 3.

When a pair of sheet holders 6 are placed side-by-side, the distance between longitudinal axes C of barrels 62 of the adjacent sheet holders 6 is the same as the distance between longitudinal axes A and B of barrels 24*a* and 24*b* of link member 5. Also, the distance between ridge portions 66 of the adjacent sheet holders 6 is just slightly greater than seating space 42. Thus, as shown in FIG. 5, when barrels 10*a* and 10*b* of a link member 5 are inserted in adjacent spaces 70 between barrels 62 of sheet holders 6, ridges 24 will lock in place between ridge portions 66 to retain barrels 24*a* and 24*b* in axial registration with the barrels 62 of the adjacent sheet holders. Barrels 10*a*, 10*b* and 62 can then be held in place against axial and lateral movement by pins 80 inserted into bores 18*a* and 18*b* and 62*a* through 62*e*, while being free to rotate with respect to each other about their longitudinal axes.

Figure 3:
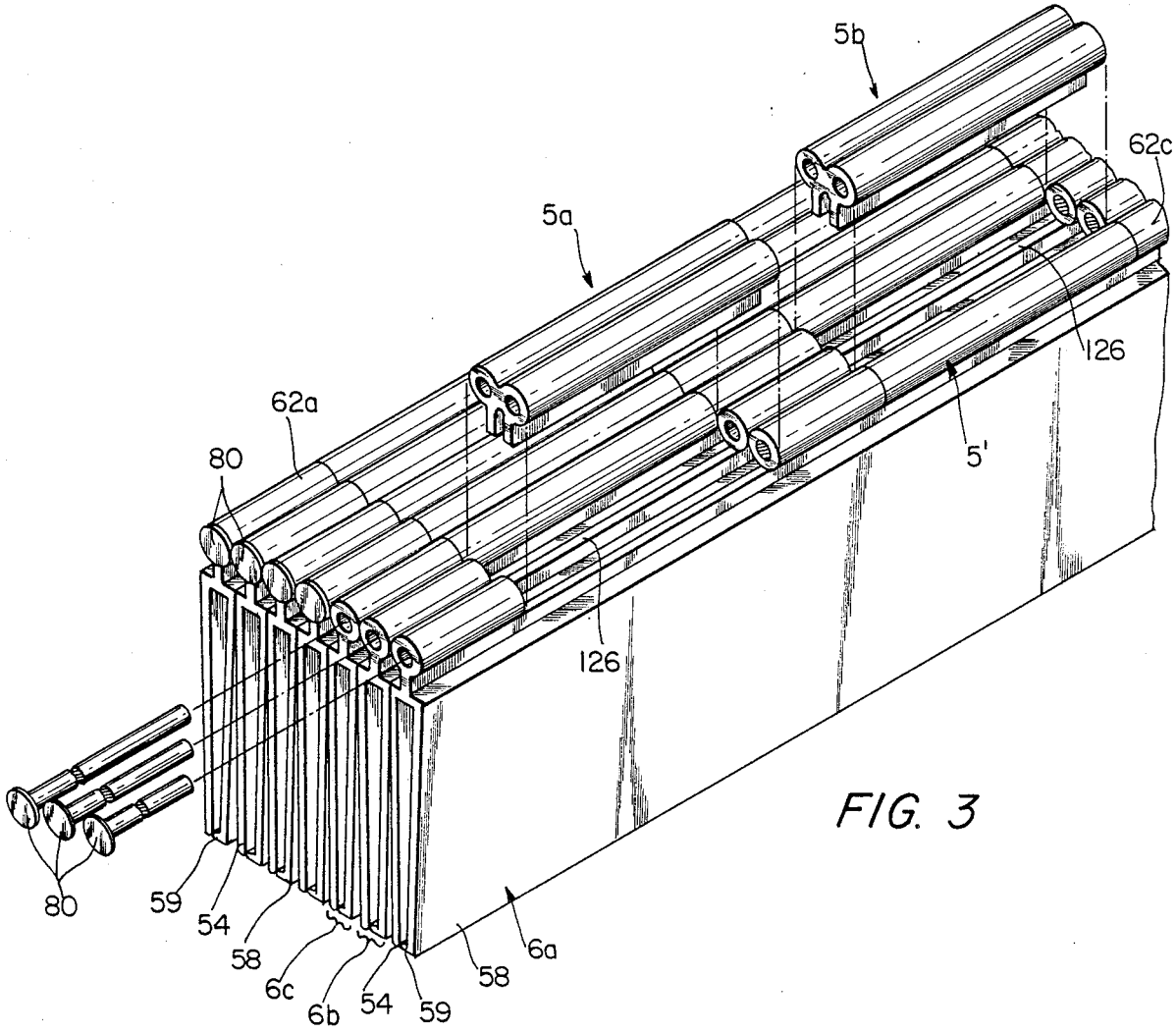
FIG. 3 is a perspective drawing of the inventive binding system with the sheet-holder portions adjacent to one another and interlinked to form a bound book containing a plurality of different sheets of material.

Because the maximum width of sheet holders 6 is the same as the distance between axes A and B of barrels 10*a* and 10*b*, a plurality of sheet holders 6 can be locked together as shown in FIGS. 3 and 4 by arranging a plurality of link members 5 in spaces 126 in a staggered relation. Moreover, because link members 5 and sheet holders 6 form a hinge, adjacent sheet holders 6 are movable with respect to each other, making it possible to more easily examine the sheets of material held therein. A binding system of almost any size can be formed using the desired number of sheet holder 6, and the size of the binding system can be increased or decreased at will by adding or subtracting sheet holders 6.

When a plurality of links 5 and a plurality of sheet holders 6 are interlocked in the manner described above, a bound book of expandable size is produced, as depicted in FIGS. 3 and 4. The invention is designed so that the links 5 are staggered with respect to the adjacent sheet holders 6. If the parts of the invention are arranged in this fashion, the linked sheet holders become interlocked, forming a tightly-bound book containing easily movable bound sheets.

This arrangement may be more clearly understood by referring to FIGS. 3 and 4, which depict a plurality of sheet holders 6 interlocked with a plurality of links 5. In FIG. 3, link 5*a* interlocks with and connects sheet holders 6*a* and 6*b*. Link 5*b* is also connected to sheet holder 6*b*, but is staggered with respect to link 5*a*, such that link 5*b* also interlocks with sheet holder 6*c*. The staggered, interlocking arrangement is repeated for every other adjacent sheet holder 6 resulting in a fully interlocked and bound book of flat material. Dummy link members 5' can be used to fill the odd spaces in the outer sheet holders in order to provide a neat appearance.

FIG. 4 provides a perspective view of a portion of a interlocked and bound book containing a plurality of sheets 100. As shown in FIG. 4, a flat sheet of material 100 is inserted into the sheet holder 6 of the present invention, such that the sheet 100 is gripped securely between the arms 54 and 58, and is held specifically by gripping lip 59. This arrangement permits assembling a book of flat material without perforating or mutilating the material forming sheet 100.

From the above, it is apparent that many modifications and variations of the present invention are possible in light of the above teachings. It is therefore to be understood that, within the scope of the appended claims, the invention may be practiced otherwise than as specifically described.

I claim:

1. A binding system for sheets of material of varying thickness, comprising:

a plurality of side-by-side elongated sheet-holding members, each of said members comprising gripping means for gripping a sheet of material and a plurality of coaxial, equally spaced-apart barrels arranged in a single row extending outwardly from said gripping means, each of said coaxial barrels having a longitudinal axis, an axial bore and an inner and outer diameter;

a plurality of link means for interlocking said plurality of sheet-holding members together in side-by-side relation, each of said link means comprising first and second parallel, connected barrels of equal size, said parallel barrels each having a longitudinal axis, an axial bore and an inner and outer diameter, said coaxial barrel inner and outer diameters being the same as said parallel barrel inner and outer diameters, said parallel barrels having a length which is substantially equal to the spaces between said coaxial barrels, and said longitudinal axes of said parallel barrels being separated by a distance equal to the distance between said longitudinal axes of said coaxial barrels of adjacent sheet-holding members, said link means being placed in staggered relation in the spaces between said coaxial barrels, whereby said parallel barrels of said link means are received between and in coaxial registration with said coaxial barrels of adjacent sheet-holding members; and a plurality of elongated pins inserted into said bores of said coaxial and said parallel barrels which are in coaxial registration.

2. The system of claim 1, said gripping means of said sheet-holding members comprising:

an elongated, planar support arm; and an elongated, planar gripping arm closely adjacent to, but spaced apart from, said support arm, said gripping arm including an elongated gripping lip.

3. The system of claim 2, wherein each of said gripping arms has planar inner and outer faces, and wherein said elongated gripping lip extends the full length of said gripping arm, and wherein said lip extends inwardly of and is secured at a right angle to said inner face of said gripping arm.

4. The system of claim 1, each of said sheet-holding members further comprising spine means for attaching said coaxial barrels to said gripping means.

5. The system of claim 2, each of said sheet-holding members further comprising spine means for joining said support and gripping arms to each other, and attaching said coaxial barrels to said support and gripping arms.

6. The invention of claim 4, each of said link means further comprising locking means for mating engagement between said spine means of adjacent sheet-holding members.

7. The invention of claim 6, said locking means comprising first and second ridges extending from said first and second barrels, respectively, of said link means.

8. The system of claim 1, said sheet-holding members being constructed of resilient material, whereby when a sheet of material is inserted between said support arm and said gripping arm, the material is retained in place between said arms through spring tension produced by said resilient material.

9. A binding system for sheets of material of varying thickness, comprising:

a plurality of side-by-side elongated sheet-holding members, each of said members comprising gripping means for gripping a sheet of material and a plurality of coaxial, spaced-apart cylindrical first hinge members arranged in a single row extending outwardly from said gripping means, said gripping means having a maximum width and each of said first hinge members having a longitudinal axis and an outer diameter;

a plurality of link means for interlocking said plurality of sheet-holding members together in side-by-side relation, each of said link means comprising first and second parallel, connected second hinge members aligned on two parallel spaced apart longitudinal axes, and said second hinge members each having an outer diameter, said first and second hinge member outer diameters being the same, said first hinge members being spaced apart by a distance which is substantially equal to the length of said second hinge members, and said longitudinal axes of said second hinge members separated by a distance substantially equal to said maximum width of said gripping means; and a plurality of fastening means for interlocking said first and second hinge members in coaxial registration.

10. The system of claim 9, said gripping means of said sheet-holding members comprising:

an elongated, planar support arm; and an elongated, planar gripping arm closely adjacent to, but spaced apart from, said support arm, said gripping arm including an elongated gripping lip.

11. The system of claim 9, wherein each of said gripping arms has planar inner and outer faces, and wherein said elongated gripping lip extends the full length of said gripping arm, and wherein said lip extends inwardly of and is secured at a right angle to said inner face of said gripping arm.

12. The system of claim 9, each of said sheet-holding members further comprising spine means for attaching said coaxial barrels to said gripping means.

13. The system of claim 10, each of said sheet-holding members further comprising spine means for joining said support and gripping arms to each other, and attaching said coaxial barrels to said support and gripping arms.

14. The invention of claim 8, each of said link means further comprising first and second ridges extending from said first and second barrels, respectively.

15. The system of claim 9, said sheet-holding members being constructed of resilient material, whereby when a sheet of material is inserted between said support arm and said gripping arm, the material is retained in place between said arms through spring tension produced by said resilient material.

* * * * *